US009368929B2

(12) United States Patent
Matsushita

(10) Patent No.: US 9,368,929 B2
(45) Date of Patent: Jun. 14, 2016

(54) METHOD FOR PROTECTING TERMINAL-CONNECTING PORTION OF INSULATED ELECTRICAL WIRE BY INSERT MOLDING

(71) Applicant: Yazaki Corporation, Tokyo (JP)

(72) Inventor: Kouichiro Matsushita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 82 days.

(21) Appl. No.: 14/246,432

(22) Filed: Apr. 7, 2014

(65) Prior Publication Data

US 2014/0215818 A1 Aug. 7, 2014

Related U.S. Application Data

(63) Continuation of application No. PCT/JP2012/006419, filed on Oct. 5, 2012.

(30) Foreign Application Priority Data

Oct. 7, 2011 (JP) ..... 2011-222807

(51) Int. Cl.

| | |
|---|---|
| ***H01R 43/00*** | (2006.01) |
| ***H01R 43/24*** | (2006.01) |
| ***H01R 13/52*** | (2006.01) |
| ***H01R 11/12*** | (2006.01) |

(52) U.S. Cl.

CPC ..... *H01R 43/005* (2013.01); *H01R 11/12* (2013.01); *H01R 13/5216* (2013.01); *H01R 43/24* (2013.01); *Y10T 29/49176* (2015.01)

(58) Field of Classification Search

CPC ..... H01R 43/005; H01R 43/24; B29C 45/14639; B29C 70/72; Y10T 29/49176; Y10T 29/4922

See application file for complete search history.

(56) References Cited

U.S. PATENT DOCUMENTS

| | | | | |
|---|---|---|---|---|
| 6,761,551 | B2 * | 7/2004 | Kondo | B29C 45/14426 425/116 |
| 2001/0003688 | A1 | 6/2001 | Kondo | |
| 2002/0127915 | A1 | 9/2002 | Kondo | |
| 2007/0026744 | A1 | 2/2007 | Takanashi | |

FOREIGN PATENT DOCUMENTS

| | | | |
|---|---|---|---|
| JP | 63124309 | A * | 5/1988 |
| JP | 2001-167640 | A | 6/2001 |

OTHER PUBLICATIONS

International Search Report and Written Opinion dated Jan. 28, 2013, issued for PCT/JP2012/006419.

* cited by examiner

*Primary Examiner* — Livius R Cazan
(74) *Attorney, Agent, or Firm* — Locke Lord LLP; James E. Armstrong, IV; Brian S. Matross

(57) ABSTRACT

A method for protecting a terminal-connecting portion of an insulated electrical wire by means of insert molding, the terminal-connecting portion being disposed at one end portion of the insulated electrical wire, comprising the step of: grounding an opposite end portion of the insulated electrical wire before the terminal-connecting portion is introduced into a die.

4 Claims, 3 Drawing Sheets

METHOD FOR PROTECTING TERMINAL-CONNECTING PORTION OF INSULATED ELECTRICAL WIRE BY INSERT MOLDING

TECHNICAL FIELD

The invention relates to a method for protecting a terminal-connecting portion of an electrical wire, to which a terminal is connected, by using resin.

BACKGROUND ART

An electrical wire which can be generally used in a wiring harness for a vehicle is connected to terminals at its both ends. Each of the terminals is received in a terminal-receiving portion of a variety of connector housings, and is capable of being electrically connected to other connectors, other electric junction box, a variety of devices or the like.

Such an electrical wire having both ends to which terminals are connected can be provided in accordance with the following process.

Firstly, an end portion of a core portion (i.e., a conductor portion) is exposed by partly removing an insulating covering from the end portion of the electrical wire. The exposed core portion (i.e., the end portion of the core portion) is disposed such that is abuts against a caulking portion (i.e., an electrical wire-connecting portion) which is disposed in the terminal, and the caulking portion is deformed by means of a terminal-caulking apparatus as disclosed in JP H6-45047 (A) such that the exposed core portion is surrounded by the caulking portion. Finally, the electrical wire is pressed by the caulking portion, and is thus electrically connected to the terminal.

Moreover, the portion in which the terminal and the electrical wire are connected to each other can be partly protected by means of (resin) insert molding for the purpose of enhancing watertight properties therein. For example, see JP 2001-167640 (A).

In this case, after the processing, visual inspection often shows that a foreign material such as fine dust is attached to the portion which is protected by the resin. The presence of the foreign material can be problematic in view of quality control or quality management. In a case where the foreign material is fine fiber, the waterproof properties of the portion sought for protection may be adversely affected. In this case, waterproof reliability can be remarkably reduced or lowered. In addition, the above problems even occur under the circumstances where maintenance, cleaning, and arrangement are properly performed.

In order to solve the above problem, the above operation may be carried out in a clean room. However, the operation inside the clean room remarkably increases cost of manufacturing.

CITATION LIST

Patent Literature

[PTL 1]

JP 2001-167640 (A)

SUMMARY OF INVENTION

Technical Problem

In order to avoid the above drawbacks or problems, the invention is provided. IN particular, the invention is provided for preventing foreign material entry into the (resin) protecting portion.

Solution to Problem

In one aspect, the invention provides a method for protecting a terminal-connecting portion of an insulated electrical wire by means of insert molding. The terminal-connecting portion is disposed at one end portion of the insulated electrical wire. The method include the step of grounding an opposite end portion of the insulated electrical wire before the terminal-connecting portion is introduced into a die.

Preferably, the grounding can be continued until the insert molding is completed.

Advantageous Effects of Invention

In accordance with the invention, foreign material can be effectively protected or prevented from entry or penetration into the pressed portion (i.e., the terminal or the area adjacent to the terminal). In other word, the foreign material cannot proceed into the molded resin portion, thereby overcoming the afore-mentioned quality control or quality management-related problems. In addition, due to the protection achieved by the above configuration, watertight or waterproof effect is further guaranteed.

BRIEF DESCRIPTION OF DRAWINGS

FIG. 1A is side view and front view of the terminal. FIG. 1B is side view and front view of the state where an end portion of the electrical wire 2 is disposed in an electrical wire-fixing piece 1*b*2 of the terminal 1. FIG. 1C is side view and front view of the state where the pressing operation is completed.

DESCRIPTION OF EMBODIMENTS

Figure 1A:
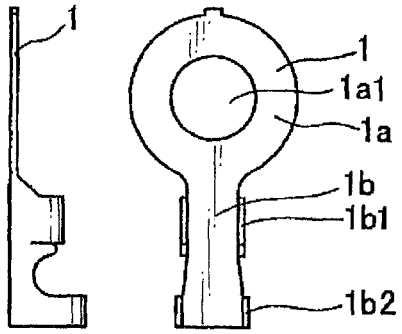
FIGS. 1A, 1B and 1C are provided for illustrating how to press a terminal against an electrical wire in accordance with the invention. In particular.

Referring to the attached drawings, a method for pressing a terminal against an electrical wire in accordance with the invention will be described in detail. FIG. 1A is a side view and front view of a terminal 1. The terminal 1 includes a connecting plate portion la having a connection hole 1*a*1 disposed therein, an electrical wire-pressing portion 1*b* having a pressing piece 1*b*1 and an electrical wire-fixing piece 1*b*2.

Figure 1B:
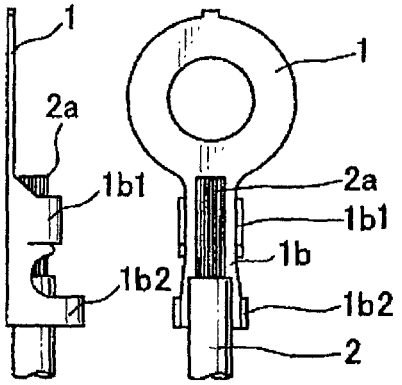
Figure 1C:
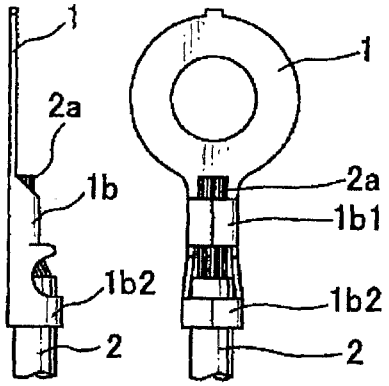

The terminal 1 can be disposed in conformity with convex and concave portions of terminal-caulking apparatus as described in JP H6-45047 (A). As shown in FIG. 1B, the terminal 1 can be pressed against the electrical wire 2 by caulking a pressing piece 1*b*1 and an electrical wire-fixing piece 1b2 while the exposed conductor portion 2a (i.e., the end portion of the conductor portion) where the insulating covering (i.e., the insulating layer) is removed from one end portion of the electrical wire 2 being in contact with the electrical wire-pressing portion 1b. As such, the electrical wire 2 can be pressed against the terminal 1.

Figure 2:
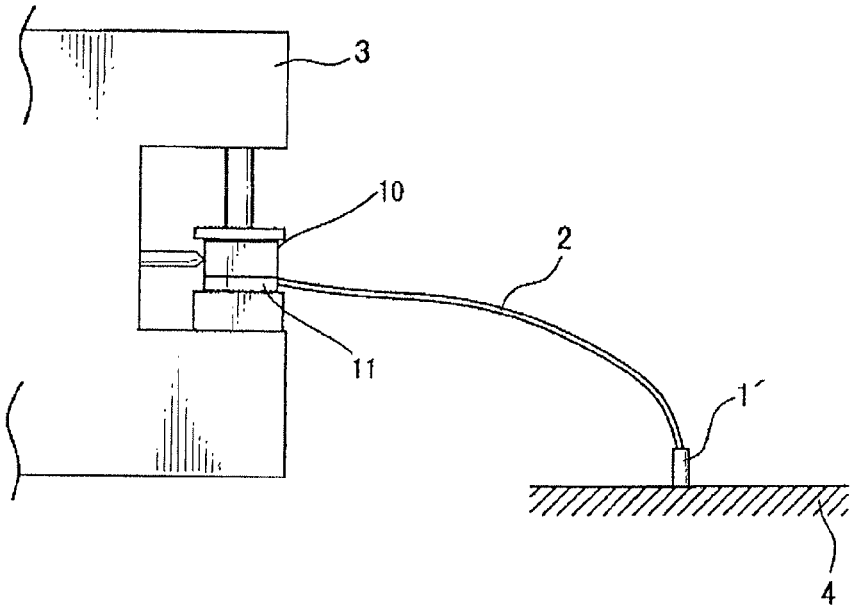
FIG. 2 depicts a state where an opposite end portion of the insulated electrical wire is grounded when the terminal-connecting portion (i.e., one end portion of the insulated electrical wire) is subjected to insert molding.
Figure 3:
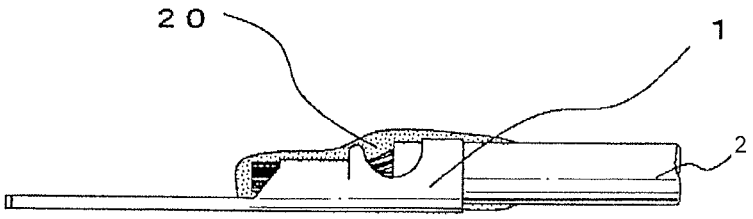
FIG. 3 depicts a state of the terminal-connecting portion which is subjected to insert molding for waterproofing.

The molded (resin) portion 20 can be shaped or formed at the terminal-connecting portion as shown in FIG. 3, by using a molding apparatus 3 as shown in FIG. 2. In this case, a primer treatment or primer application may be performed on the terminal-connecting portion for the purpose of enhancing adhesiveness to the resin portion.

Figure 4A:
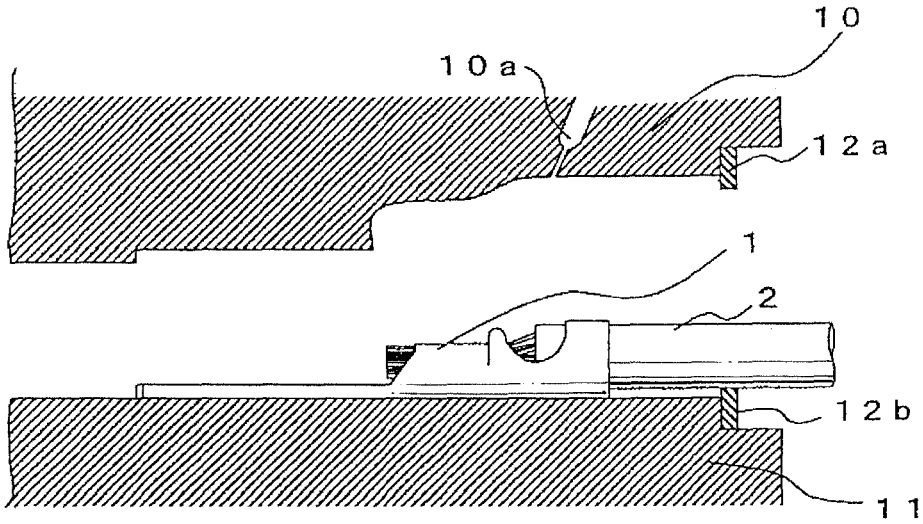
FIGS. 4A to 4C depict a waterproofing process for the terminal-connecting portion by means of insert molding.

Referring to FIG. 4A, a terminal to which one end portion of the electrical wire is attached can be disposed at a predetermined location between an upper die 10 and a lower die 11. A set of dies can be formed of the upper die 10 and the lower die 11. In more detail, the terminal 1 can be properly disposed on the lower die 11. When the terminal 1 is located as such, the other end portion 1' (i.e., an opposite end portion) of the electrical wire 2 can be come in contact with a grounding table 4 which is disposed adjacent to the molding apparatus 3.

Figure 4B:
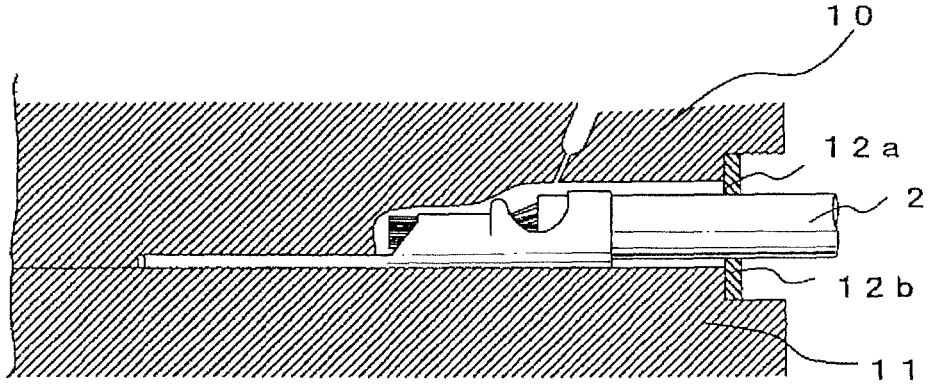
Figure 4C:
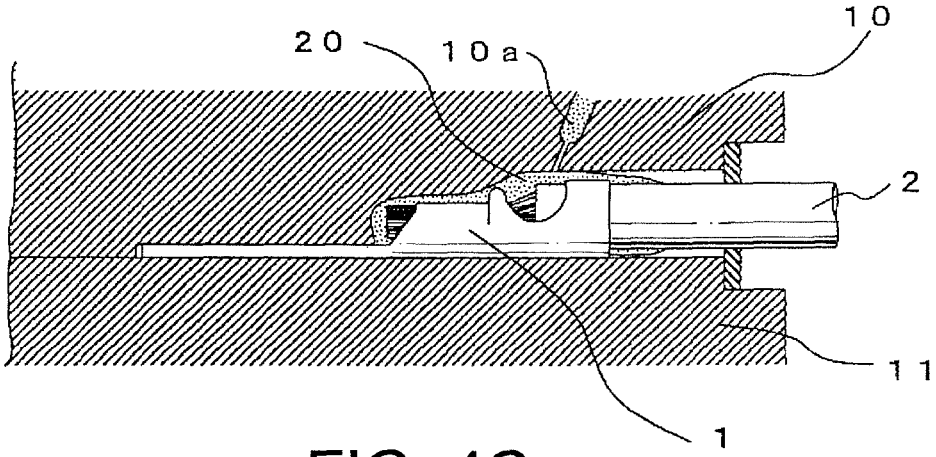

Next referring to FIG. 4B, the upper die 10 and the lower die 11 approximate to each other, and are then closed. In this configuration, the electrical wire 2 can remain airtight by a cap plate 12a attached to the upper die 10, and a separate cap plate 12b attached to the lower die 11. The cap plates 12a, 12b may be formed of elastic, heat-resistant rubber. The above configuration then creates a cavity therein. Then, a resin can be injected through a runner portion (a passage for resin) 10a into the cavity, thereby obtaining a resin-molded portion or molded resin portion 20.

Subsequently, after the molded resin portion 20 is formed, the upper and lower dies are opened, thereby removing or collecting the resin-molded or resin-protected terminal-connecting portion from the set of dies (i.e., the upper and lower dies).

Due to grounding the voltages to ground of the electrical wire 2 and the terminal 1 are 0 during the shaping or formation, and before or after the shaping or formation. As a result, the foreign material is substantially prevented from entry or penetration into the terminal 1 or the area adjacent to the terminal 1. In other word, the foreign material cannot proceed into the molded resin portion 20, thereby overcoming the afore-mentioned quality control or quality management-related problems. In addition, due to the protection achieved by the above configuration, watertight or waterproof effect is securely guaranteed.

EXAMPLE 1

A method for protecting a terminal-connecting portion of an insulated electrical wire by means of insert molding will be described in detail with reference the following examples.

An insulated electrical wire having both end portions each connected to terminals is provided for use in a vehicle wiring harness. The length of the insulated electrical wire was three meters. The insulated electrical wire was comprised of a core portion formed of seven copper core wires and having a cross-sectional area of 2.5 $mm^2$, and an insulating covering formed of non-halogen, olefin-based frame retardant composition containing calcium oxide and having an outer diameter of 2.8 mm.

For three insulated electrical wires per one lot or batch, terminals were pressed against both end portions of the insulated electrical wires. Firstly, olefin-based primer was applied onto the terminal-connecting portion to be protected by the resin (i.e., priming process).

Then, transparent ADMER resin as a molding resin was injected into the terminal-connecting portion which had already been subjected to the above priming process. In other words, the terminal-connecting portion was subjected to injection molding. The protection can be obtained by insert molding of the terminal-connecting portion of the insulated electrical wire. In this case, when the terminal attached to the electrical wire (i.e., the one end portion of the electrical wire) was located in a set of dies, the other or opposite end portion of the electrical wire was grounded as shown in FIG. 2.

On the other hand, separate three electrical wires per one lot or batch were subjected to the same treatments excluding that the grounding was not carried out by using the grounding table. All of the latter electrical wires were found to have foreign material having a diameter of about 0.5 mm inside a sleeve.

REFERENCE SIGNS LIST

1 terminal
1a connecting plate portion
1a1 connection hole
1b electrical wire pressing portion
1b1 pressing piece
1b2 electrical wire-fixing piece
2 electrical wire
2a conductor portion (i.e., core portion)
3 molding apparatus
4 ground table
20 molded resin portion

The invention claimed is:

1. A method for protecting a terminal-connecting portion of an insulated electrical wire connected to a terminal, the terminal-connecting portion being disposed at a first end portion of the insulated electrical wire, comprising the step of:

grounding a second end portion of the insulated wire opposite the first end portion of the insulated electrical wire before the terminal-connecting portion is introduced into a die;

introducing the first end portion into the die while the second end portion remains grounded to a structure; and insert-molding the terminal-connecting portion of the insulated electrical wire while the second end portion remains grounded to the structure at a state where both voltage to ground of the insulated electrical wire and voltage to ground of the terminal are 0.

2. The method according to claim 1, wherein the grounding is continued until the insert molding is completed.

3. The method according to claim 1, wherein the grounding is conducted by attaching the second end portion of the insulated electrical wire to a structure adjacent the die.

4. A method for protecting a terminal-connecting portion of an insulated electrical wire connected to a terminal, the terminal-connecting portion being disposed at a first end portion of the insulated electrical wire, comprising the steps of:

grounding a second end portion of the insulated wire opposite the first end portion of the insulated electrical wire to a structure adjacent a die before the terminal-connecting portion is introduced into the die;

introducing the first end portion into the die while the second end portion remains grounded to the structure; and insert-molding the terminal-connecting portion of the insulated electrical wire while the second end portion remains grounded to the structure at a state where both voltage to ground of the insulated electrical wire and voltage to ground of the terminal are 0.

* * * * *